US010915054B2

(12) United States Patent
Ajima

(10) Patent No.: US 10,915,054 B2
(45) **Date of Patent: *Feb. 9, 2021**

(54) IMAGE FORMING APPARATUS AND CONTROL METHOD OF IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Hisanobu Ajima, Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/905,709

(22) Filed: Jun. 18, 2020

(65) Prior Publication Data

US 2020/0319586 A1 Oct. 8, 2020

Related U.S. Application Data

(63) Continuation of application No. 15/919,670, filed on Mar. 13, 2018, now Pat. No. 10,719,045.

(51) Int. Cl.
*G03G 15/08* (2006.01)
*G03G 15/00* (2006.01)

(52) U.S. Cl.
CPC ..... *G03G 15/556* (2013.01); *G03G 15/0856* (2013.01); *G03G 15/0872* (2013.01); *G03G 15/0879* (2013.01); *G03G 15/0891* (2013.01); *G03G 15/5016* (2013.01)

(58) Field of Classification Search
CPC ..... G03G 15/556; G03G 15/0856
See application file for complete search history.

(56) References Cited

U.S. PATENT DOCUMENTS 7,400,837 B2 7/2008 Koyama
8,554,091 B2 10/2013 Homma et al.
(Continued)

OTHER PUBLICATIONS

Notice of Allowance on U.S. Appl. No. 15/919,670 dated Mar. 13, 2020.

*Primary Examiner* — Walter L Lindsay, Jr.
*Assistant Examiner* — Milton Gonzalez
(74) *Attorney, Agent, or Firm* — Foley & Lardner LLP

(57) ABSTRACT

An image forming apparatus includes a toner cartridge, a developer, and a processor. The toner cartridge includes an accommodation container accommodating toner and a memory storing a first toner residual amount display threshold value. The developer performs development by the toner supplied from the toner cartridge. The processor calculates a second toner residual amount display threshold value based on a toner supply index, indicating an amount of the toner supplied to the developer from at least one toner cartridge used before a toner cartridge mounted on the image forming apparatus, and the first toner residual amount display threshold value. The processor outputs notification relating to a toner residual amount when a toner supply index indicating an amount of toner supplied to the developer from the toner cartridge mounted on the image forming apparatus exceeds the second toner residual amount display threshold value.

17 Claims, 9 Drawing Sheets

(56) References Cited

U.S. PATENT DOCUMENTS

| | | | | |
|---|---|---|---|---|
| 8,649,694 | B2 * | 2/2014 | Mitsui | G03G 15/0863 399/27 |
| 2016/0274492 | A1 | 9/2016 | Niijima | |
| 2018/0284681 | A1 | 10/2018 | Yabuki | |

* cited by examiner

FIG. 4

94

| ADDRESS | INFORMATION |
|---|---|
| A001 | IDENTIFICATION CODE |
| A002 | FIRST TONER RESIDUAL AMOUNT DISPLAY THRESHOLD VALUE |
| A003 | SECOND TONER RESIDUAL AMOUNT DISPLAY THRESHOLD VALUE |
| A004 | TONER SUPPLY MOTOR OPERATION TIME |
| A005 | TONER END COUNTER VALUE (FIRST PREVIOUS) |
| A006 | TONER END COUNTER VALUE (SECOND PREVIOUS) |
| A007 | TONER END COUNTER VALUE (THIRD PREVIOUS) |

FIG. 5

53

| ADDRESS | INFORMATION |
|---|---|
| B001 | IDENTIFICATION CODE |
| B002 | FIRST TONER RESIDUAL AMOUNT DISPLAY THRESHOLD VALUE |
| B003 | TONER SUPPLY MOTOR OPERATION TIME |

FIG. 9

94

| ADDRESS | INFORMATION |
|---|---|
| A001 | IDENTIFICATION CODE |
| A002 | FIRST TONER RESIDUAL AMOUNT DISPLAY THRESHOLD VALUE |
| A003 | SECOND TONER RESIDUAL AMOUNT DISPLAY THRESHOLD VALUE |
| A004 | APPARATUS NUMBER A (OWN IMAGE FORMING APPARATUS) |
| A005 | TONER SUPPLY MOTOR OPERATION TIME |
| A006 | HISTORY OF TONER END COUNTER (FIRST PREVIOUS) |
| A007 | APPARATUS NUMBER A |
| A008 | TONER SUPPLY MOTOR OPERATION TIME |
| A009 | APPARATUS NUMBER B |
| A010 | TONER SUPPLY MOTOR OPERATION TIME |
| A011 | APPARATUS NUMBER C |
| A012 | TONER SUPPLY MOTOR OPERATION TIME |
| A013 | HISTORY OF TONER END COUNTER (SECOND PREVIOUS) |
| A014 | APPARATUS NUMBER A |
| A015 | TONER SUPPLY MOTOR OPERATION TIME |
| A016 | APPARATUS NUMBER B |
| A017 | TONER SUPPLY MOTOR OPERATION TIME |
| | |
| | |
| An | APPARATUS NUMBER A |
| An+1 | TONER SUPPLY MOTOR OPERATION TIME |
| | |

53

| ADDRESS | INFORMATION |
|---|---|
| B001 | IDENTIFICATION CODE |
| B002 | FIRST TONER RESIDUAL AMOUNT DISPLAY THRESHOLD VALUE |
| B003 | APPARATUS NUMBER A |
| B004 | TONER SUPPLY MOTOR OPERATION TIME |
| B005 | APPARATUS NUMBER B |
| B006 | TONER SUPPLY MOTOR OPERATION TIME |
| B007 | APPARATUS NUMBER C |
| B008 | TONER SUPPLY MOTOR OPERATION TIME |
| | |

IMAGE FORMING APPARATUS AND CONTROL METHOD OF IMAGE FORMING APPARATUS

CROSS-REFERENCE TO RELATED APPLICATION

This application is a continuation of and claims priority to co-pending U.S. application Ser. No. 15/919,670 filed Mar. 13, 2018, the entire contents of which are incorporated herein by reference.

FIELD

Embodiments described herein relate generally to an image forming apparatus and a control method of an image forming apparatus.

BACKGROUND

In an image forming apparatus, a photosensitive drum is charged, the photosensitive drum is irradiated with light corresponding to printing image data (print data), and thus, a latent image (electrostatic latent image) is formed on the photosensitive drum. In the image forming apparatus, toner (developing agent) is attached from a developer to the latent image formed on the photosensitive drum, the toner attached to the latent image is transferred to a printing medium, and thus, a toner image is formed on the printing medium. In the image forming apparatus, the printing medium on which the toner image is formed is interposed between fixing rollers heated by a heater, and the toner image formed on the printing medium is fixed. There is an image forming apparatus in which toner is supplied from a toner cartridge to a developer.

There is an image forming apparatus in which a toner cartridge does not include a residual amount measurement sensor for measuring a residual amount of toner inside the toner cartridge. In this case, in the image forming apparatus, based on a driving time of a motor which drives a screw for supplying the toner from the toner cartridge to the developer, the number of pixels counted by a pixel counter, or the like, the residual amount of the toner inside the toner cartridge is estimated. In the image forming apparatus, based on the estimated toner residual amount, the toner cartridge being nearly empty is displayed on a display unit of the image forming apparatus.

However, an inertia rotation of the screw occurs even after the motor stops, and thus, a large deviation between an actual toner supply amount and the estimated toner residual amount may occur.

DESCRIPTION OF THE DRAWINGS

FIG. 4 is a diagram for explaining examples of information stored in a nonvolatile memory of a system controller according to a first embodiment.

FIG. 5 is a diagram for explaining examples of information stored in a memory of a toner cartridge according to the first embodiment.

FIG. 9 is a diagram for explaining examples of information stored in a nonvolatile memory of a system controller according to a second embodiment.

DETAILED DESCRIPTION

An image forming apparatus and a control method of an image forming apparatus according to some embodiments is described with reference to the drawings.

Figure 1:
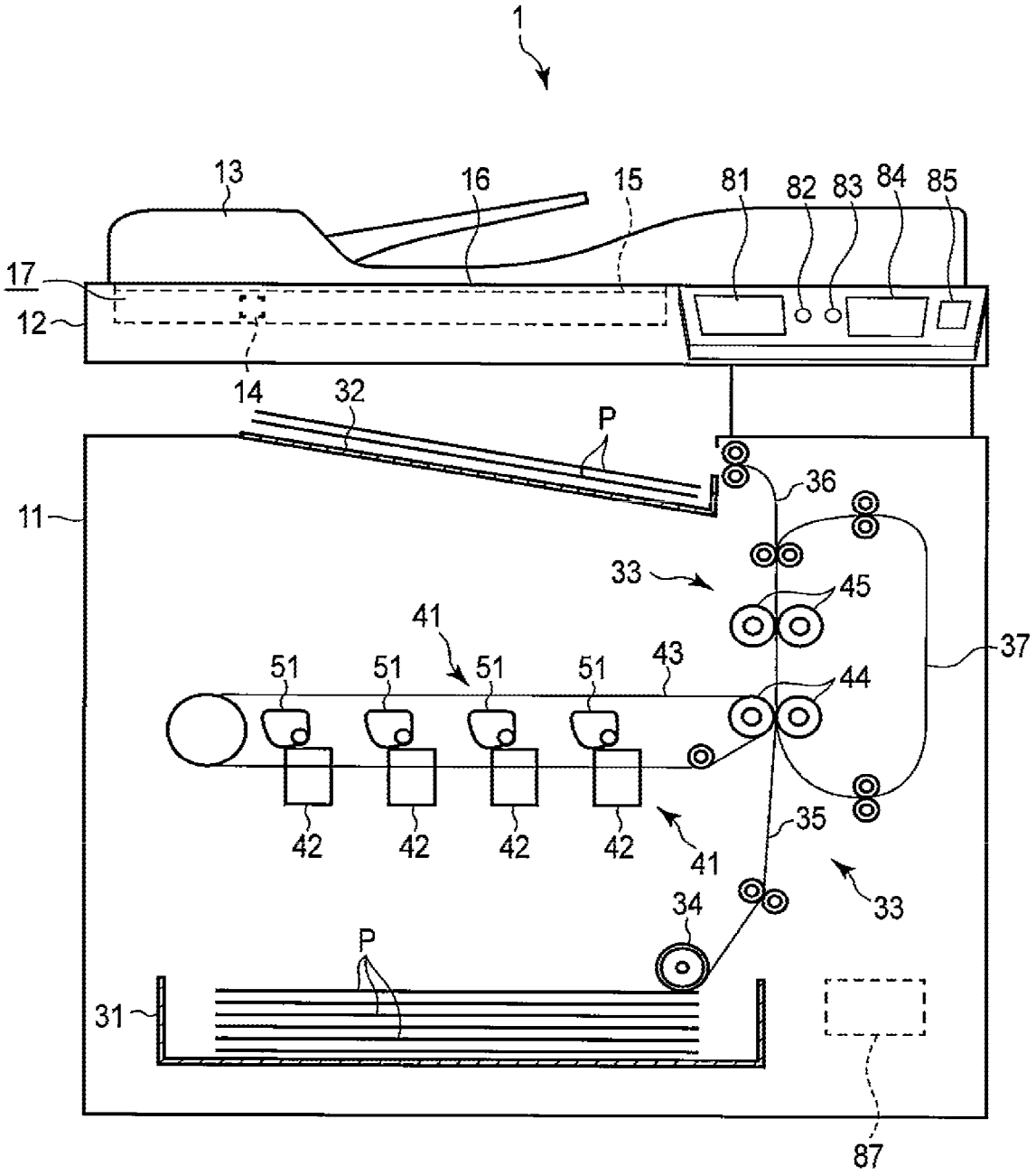
FIG. 1 is a diagram for explaining a configuration example of an image forming apparatus according to some embodiments.

FIG. 1 is a diagram for explaining a configuration example of the image forming apparatus 1 according to some embodiments.

For example, an image forming apparatus 1 may be a multifunction printer (MFP) which performs various processes such as image forming while conveying a recording medium such as a printing medium. For example, the image forming apparatus 1 may be a solid scanning type printer (for example, an LED printer) which performs various processes such as image forming while conveying a recording medium such as a printing medium and performs scanning with an LED array.

In the image forming apparatus 1, a photosensitive drum is charged, the photosensitive drum is irradiated with light corresponding to printing image data (print data), and thus, an electrostatic latent image is formed on the photosensitive drum. In the image forming apparatus 1, toner is attached to the latent image formed on the photosensitive drum, the toner attached to the latent image is transferred to the printing medium, and thus, a toner image is formed on the printing medium. In the image forming apparatus 1, the printing medium on which the toner image is formed is interposed between fixing rollers heated by a heater, and the toner image formed on the printing medium is fixed.

In the image forming apparatus 1, reflected light of the light with which the printing medium is irradiated is imaged by an image sensor, a charge accumulated in the image sensor is read and converted into a digital signal, and thus, the image of the printing medium is acquired.

As shown in FIG. 1, the image forming apparatus 1 includes an arrangement of a housing 11, an image reading system, a conveyance system, an image forming system, a control system, various interfaces, or the like. The housing 11 is a main body which holds each configuration of the image forming apparatus 1.

First, the image reading system of the image forming apparatus 1 will be described.

As shown in FIG. 1, the image forming apparatus 1 includes an original document table 12, an automatic original document feeder (ADF) 13, and a scanner unit 14 as a configuration for reading an image from an original document.

A printing medium P serving as the original document is placed on the original document table 12. The original document table 12 includes a glass plate 15 on which the printing medium P serving as the original document is placed and a space 17 positioned on a surface opposite to a document placing surface 16 of the glass plate 15 on which the printing medium P serving as the original document is placed.

The ADF 13 is a mechanism which conveys the printing medium P. The ADF 13 is provided on the original document table 12 so as to be freely opened and closed. According to a control of a system controller 87, the ADF 13 takes-in the printing medium P disposed in a tray and conveys the taken-in printing medium P while causing the printing medium P to come into close contact with the glass plate 15 of the original document table 12.

The scanner unit 14 acquires the image from the printing medium P according to the control of the system controller 87. The scanner unit 14 is disposed on the space 17 on the side opposite to the document placing surface 16 of the original document table 12. The scanner unit 14 includes an image sensor, an optical element, an illuminator, or the like.

The image sensor is an imaging element in which pixels for converting light into an electric signal (image signal) are arranged in a linear shape. For example, the image sensor includes a Charge Coupled Device (CCD), a Complementary Metal Oxide Semiconductor (CMOS), or other imaging elements.

The optical element images light from a predetermined reading range on the pixel of the image sensor. The reading range of the optical element is a linear region on the document placing surface 16 of the original document table 12. The optical element images the light, which is reflected by the printing medium P placed on the document placing surface 16 of the original document table 12 and transmits the glass plate 15, on the pixel of the image sensor.

The printing medium P is irradiated with the light by the illuminator. The illuminator includes an optical source and a light guide through which the printing medium P is irradiated with the light from the optical source. A region including the reading range of the optical element is irradiated with the light emitted from the optical source through the light guide by the illuminator.

When the printing medium P is placed on the document placing surface 16 of the original document table 12, the scanner unit 14 is driven in a sub-scanning direction, which is orthogonal to an arrangement direction (main-scanning direction) of the pixels of the image sensor and is parallel to the document placing surface 16, by a drive mechanism (not shown). The scanner unit 14 is driven in the sub-scanning direction and continuously acquires an image one line at a time by the image sensor, and thus, the entire image data (original document image data) of the printing medium P placed on the document placing surface 16 of the original document table 12 is acquired.

When the printing medium P is conveyed by the ADF 13, the scanner unit 14 is driven at a position facing a position at which the scanner unit 14 comes into close contact with the printing medium P by the ADF 13. The scanner unit 14 continuously acquires the image one line at a time from the printing medium P conveyed by the ADF 13 by the image sensor, and thus, the entire image data (original document image data) of the printing medium P conveyed by the ADF 13 is acquired.

Next, the conveyance system of the image forming apparatus 1 will be described.

As shown in FIG. 1, the image forming apparatus 1 includes a paper feeding cassette 31, a paper discharge tray 32, and a conveyance unit 33 as the configurations of the conveyance system.

The paper feeding cassette 31 is a cassette in which the printing medium P is accommodated. The paper feeding cassette 31 is configured to be able to supply the printing medium P from the outside of the housing 11. For example, the paper feeding cassette 31 is configured to be able to be withdrawn from the housing 11.

The paper discharge tray 32 is a tray which supports the printing medium P discharged from the image forming apparatus 1.

The conveyance unit 33 conveys the printing medium P. The conveyance unit 33 includes a conveyance path including a plurality of guides and a plurality of rollers, and a sensor which detects a conveyance position of the printing medium P by the conveyance path. The conveyance path is a path through which the printing medium P is conveyed. The conveyance rollers are rotated by a motor operated based on the control of the system controller 87, and thus, convey the printing medium P along the conveyance path. Some guides among the plurality of guides are rotated by the motor operated based on the control of the system controller 87, and thus, switch the conveyance path through which the printing medium P is conveyed.

For example, as shown in FIG. 1, the conveyance unit 33 includes a take-in roller 34, a paper feed conveyance path 35, a paper discharge conveyance path 36, and a reverse conveyance path 37.

The take-in roller 34 takes-in the printing medium P accommodated in the paper feeding cassette 31 to the paper feed conveyance path 35.

The paper feed conveyance path 35 is a conveyance path through which the printing medium P taken-in from the paper feeding cassette 31 by the take-in roller 34 is conveyed to an image forming unit 41.

The paper discharge conveyance path 36 is a conveyance path through which the printing medium P having the image formed by the printing forming unit 41 is discharged from the housing 11. The printing medium P discharged through the paper discharge conveyance path 36 is discharged to the paper discharge tray 32.

The reverse conveyance path 37 is a conveyance path through which the printing medium P is supplied to the image forming unit 41 again in a state where front and rear surfaces, front side and rear side, or the like of the printing medium P having the image formed by the image forming unit 41 are reversed.

Next, the image forming system of the image forming apparatus 1 will be described.

As shown in FIG. 1, the image forming apparatus 1 includes the image forming unit 41 as the configuration of the image forming system.

The image forming unit 41 forms the image on the printing medium P based on the control of the system controller 87. The image forming unit 41 includes a plurality of process units 42, a transfer belt 43, a pair of transfer rollers 44, a pair of fixing rollers 45, and a plurality of toner cartridges 51. For example, the image forming unit 41 includes the process units 42 for different colors such as cyan, magenta, yellow, and black.

Figure 2:
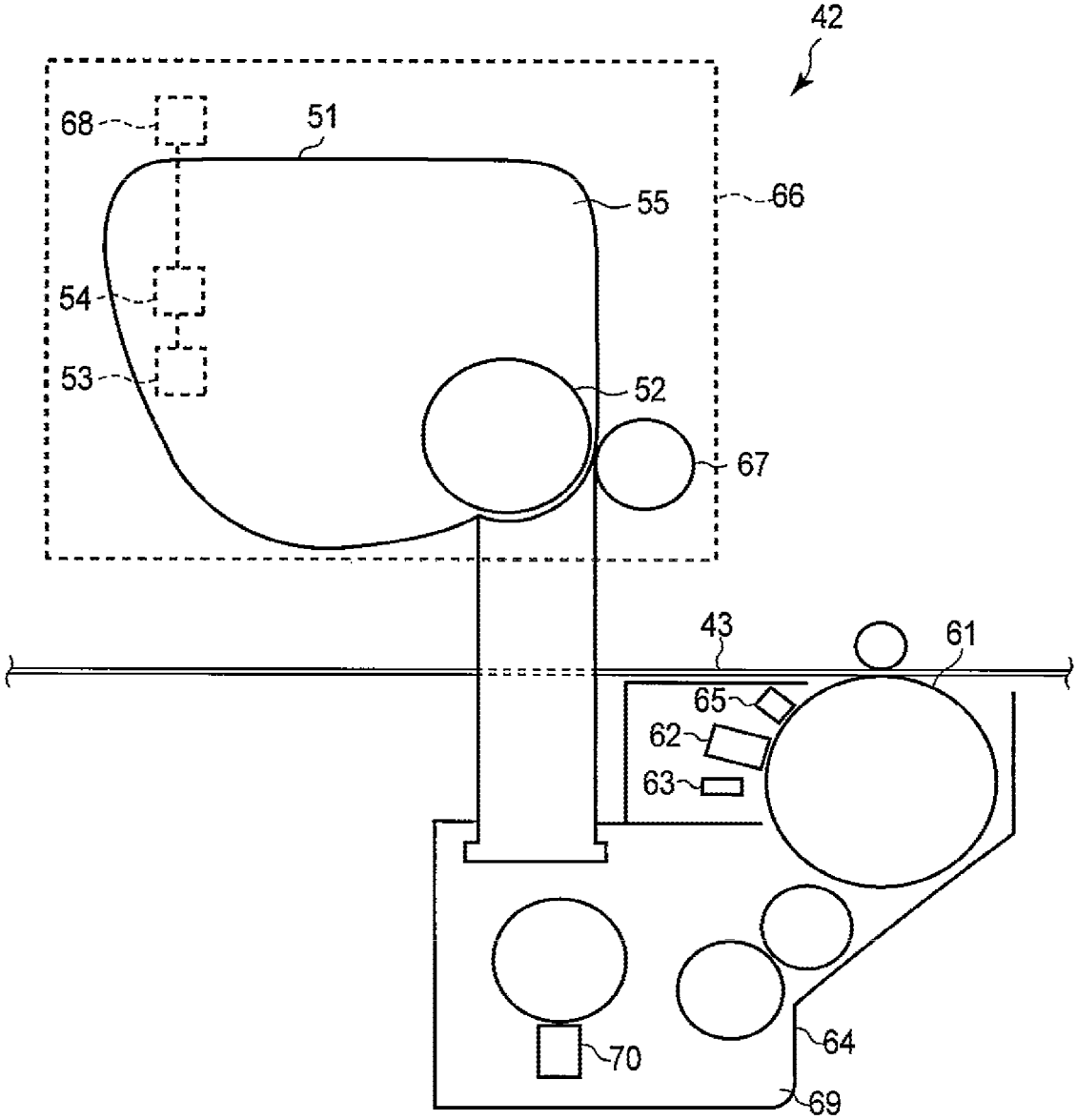
FIG. 2 is a diagram for explaining a configuration example of a process unit according to some embodiments.

FIG. 2 is a diagram for explaining a configuration of one among the plurality of process units 42. The process units 42 have the same arrangement as each other, and thus, only one will be described as a representative.

The toner cartridge 51 filled with the toner is connected to the process unit 42. The toner cartridge 51 has an accommodation container 55 filled with the toner. The accommodation container 55 of the toner cartridge 51 is filled with the toner having a different color for each process unit 42. That is, the toner cartridge 51 filled with cyan toner is connected to the process unit 42 corresponding to the cyan. The toner cartridge 51 filled with magenta toner is connected to the process unit 42 corresponding to the magenta. The toner cartridge 51 filled with yellow toner is connected to the process unit 42 corresponding to the yellow. The toner cartridge 51 filled with black toner is connected to the process unit 42 corresponding to the black.

The toner cartridge 51 includes a toner feed-out mechanism 52 for feeding the toner in the toner cartridge 51 to the process unit 42, a memory 53 in which various information is stored, and a communication interface 54 which is connected to the memory 53. The toner feed-out mechanism 52 is a screw which is rotated to feed out the toner. For example, the memory 53 includes a storage region in which an "identification code" indicating a type, a model number, or the like of the toner cartridge 51 is stored, a storage region in which a "first toner residual amount display threshold value" which is a reference value of a threshold value used to determine a residual amount of the toner is stored, and a storage region in which a toner supply motor operation time described later is stored. The first toner residual amount display threshold value is set in consideration of inherent characteristics of the toner in the toner cartridge 51 and is stored in the memory 53.

The process unit 42 is a unit which receives the toner from the toner cartridge 51 so as to form the image (toner image) of the toner for forming the image on the printing medium P on the transfer belt 43. The process unit 42 charges a drum and an electrostatic latent image corresponding to the print data is formed on the charged drum. In the process unit 42, the toner is attached to the latent image formed on the drum, and the toner attached to the electrostatic latent image is transferred to the transfer belt 43.

As shown in FIG. 2, the process unit 42 includes a drum 61, an electrostatic charger 62, an exposure unit 63, a developer 64, a cleaner 65, a loading unit 66, and a toner supply motor 67.

The drum 61 is a photosensitive drum which is formed in a cylindrical shape. The drum 61 is provided to come into contact with the transfer belt 43. The drum 61 is rotated at a constant speed by a drive mechanism (not shown).

The electrostatic charger 62 uniformly charges the surface of the drum 61.

The exposure unit 63 forms the electrostatic latent image on the charged drum 61. In the exposure unit 63, the surface of the drum 61 is irradiated with a laser light by a light-emitting element or the like according to the print data, and thus, the electrostatic latent image is formed on the surface of the drum 61. The exposure unit 63 includes a light-emitting unit and an optical element.

The light emitting unit has a configuration (for example, LED array) in which light emitting elements emitting light according to the electric signal (image signal) are arranged in a linear shape. The light emitting element of the light emitting unit emits light having a wavelength capable of forming the latent image on the charged drum 61. The light emitted from the light emitting unit is imaged on the surface of the drum 61 by the optical element.

The cleaner 65 removes the toner remaining on the drum 61 using a blade coming into contact with the drum 61.

The loading unit 66 is a mechanism on which the toner cartridge 51 filled with the toner is loaded. The loading unit 66 includes a terminal 68 which is connected to the communication interface 54 of the toner cartridge 51 when the toner cartridge 51 is loaded on the loading unit 66. The toner cartridge 51 is connected to the developer 64 via a duct when the toner cartridge 51 is loaded on the loading unit 66.

The toner supply motor 67 is a mechanism which feeds the toner in the toner cartridge 51 loaded on the loading unit 66 to the developer 64. For example, the toner supply motor 67 is connected to the toner feed-out mechanism 52 for feeding the toner in the toner cartridge 51 to the developer 64 when the toner cartridge 51 is loaded on the loading unit 66. The toner supply motor 67 transmits a rotation to the toner feed-out mechanism 52, and thus, the toner in the toner cartridge 51 is supplied to the developer 64.

The developer 64 performs development by the toner of the toner cartridge 51 loaded on the loading unit 66. The developer 64 includes an accommodation unit 69 in which the toner fed out from the toner cartridge 51 by the toner supply motor 67 is accommodated and a toner residual amount measurement sensor 70 which measures a residual amount of the toner accommodated in the accommodation unit 69. The developer 64 feeds the toner in the accommodation unit 69 to the drum 61 side, and thus, the toner is attached to the electrostatic latent image formed on the drum 61. Accordingly, the toner image is formed on the surface of the drum 61.

For example, the toner residual amount measurement sensor 70 may include a coil and measures a voltage value generated in the coil. That is, the toner residual amount measurement sensor 70 measures a magnetic flux density, generates a signal indicating a voltage corresponding to the amount of the toner remaining in the accommodation unit 69, and supplies the signal indicating the voltage corresponding to the toner residual amount to the system controller 87.

The transfer belt 43 is a member which receives the toner image formed on the surface of the drum 61 so as to transfer the toner image to the printing medium P. The transfer belt 43 is moved by the rotation of the roller. The transfer belt 43 receives the toner image formed on the drum 61 at a position at which the transfer belt 43 comes into contact with the drum 61 and conveys the received toner image to the pair of the transfer rollers 44.

The pair of transfer rollers 44 is configured such that the transfer belt 43 and the printing medium P are interposed therebetween. The pair of transfer rollers 44 transfers the toner image on the transfer belt 43 to the printing medium P.

The pair of fixing rollers 45 is configured such that the printing medium P is interposed therebetween. The pair of fixing rollers 45 is heated by a heater (not shown). A pressure is applied to the printing medium P interposed between the pair of fixing rollers 45 in a state where the pair of fixing rollers 45 is heated, and thus, the toner image is fixed to the printing medium P. That is, the pair of fixing rollers 45 fixes the toner image, and thus, the image is formed on the printing medium P.

Next, a control system of the image forming apparatus 1 will be described.

Figure 3:
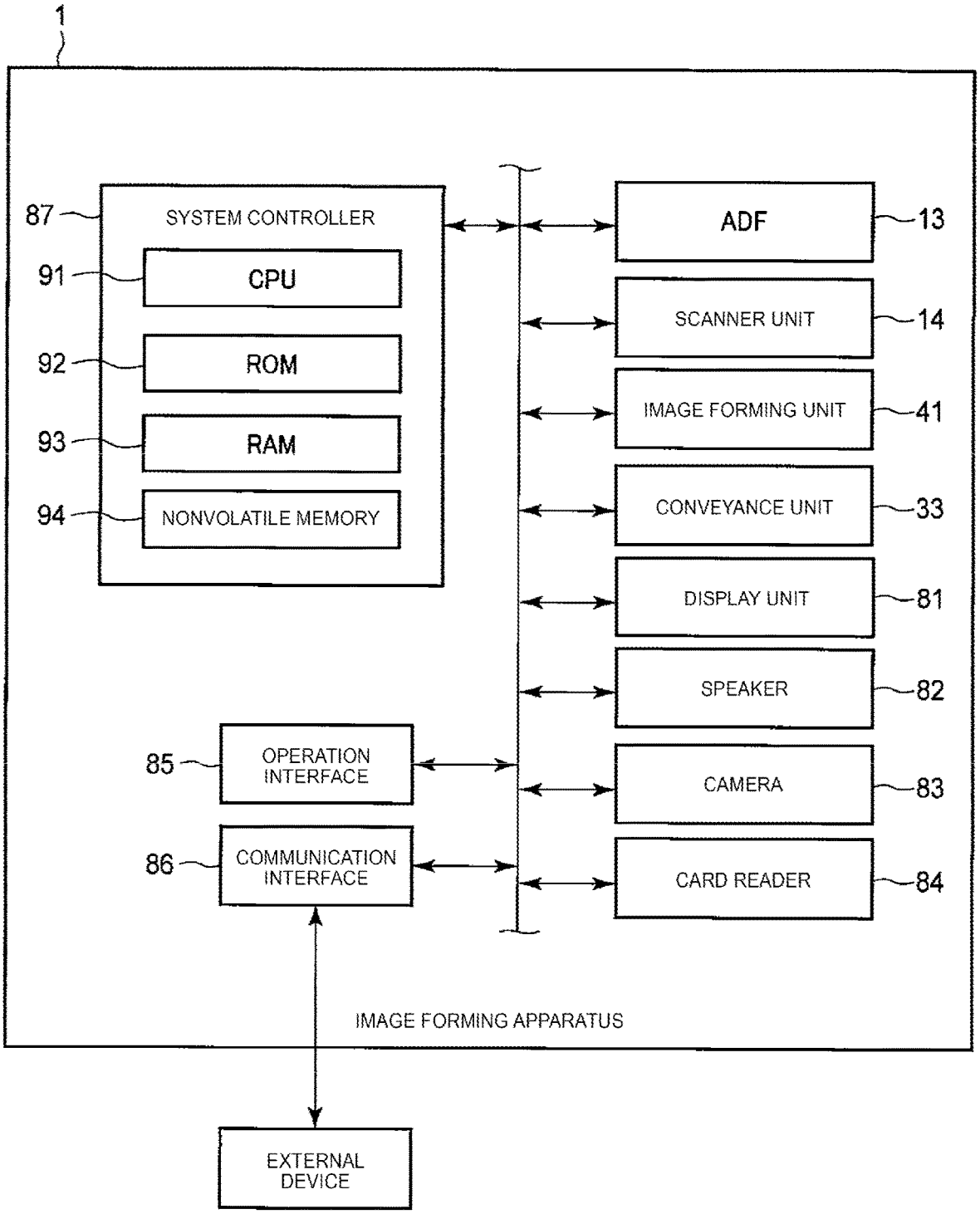
FIG. 3 is a diagram for explaining configuration examples of a control system and various interfaces of the image forming apparatus according to some embodiments.

As shown in FIG. 3, the image forming apparatus 1 includes a display unit 81, a speaker 82, a camera 83, a card reader 84, an operation interface 85, a communication interface 86, and the system controller 87 as the control system and the various interfaces of the image forming apparatus 1.

The display unit 81 includes a display which displays a screen according to a video signal input from a display control unit such as the system controller 87 or a graphic controller (not shown). For example, screens for various settings of the image forming apparatus 1 are displayed on the display on the display unit 81.

The speaker 82 outputs a voice according to a sound signal input from the system controller 87. For example, the speaker 82 outputs an alert to a user operating the image forming apparatus 1 as a voice.

The camera 83 acquires a facial photograph of a person who operates the image forming apparatus 1. The camera 83 includes an image sensor, an optical element, or the like.

The image sensor is an imaging element in which pixels for converting light to an electric signal (image signal) are arranged in a linear shape. For example, the image sensor may include a CCD, a CMOS, or other imaging elements.

The optical element images the light from a predetermined reading range on the pixels of the image sensor. The reading range of the optical element is a predetermined range near the image forming apparatus 1, and is a range within which it is assumed that a face of a user operating the image forming apparatus 1 is reflected.

The card reader 84 is an interface for communicating with an IC card possessed by the user of the image forming apparatus 1. The card reader 84 exchanges data with the IC card by contact communication or noncontact communication.

The IC card includes an IC chip and a communication circuit. The IC chip includes a CPU, a ROM, a RAM, a nonvolatile memory, or the like. The nonvolatile memory of the IC chip has identification information indicating a user possessing the IC card. For example, the communication circuit is configured of an antenna or a contact terminal (contact pattern). The communication circuit is electrically and magnetically connected to the card reader 84.

The card reader 84 communicates with the IC card, and thus, acquires the identification information indicating the user possessing the IC card from the IC card.

The operation interface 85 is connected to an operation member (not shown). The operation interface 85 supplies an operation signal corresponding to an operation of the operation member to the system controller 87. For example, the operation member may include a touch sensor, a numeric keypad, a power key, a paper feed key, various function keys, a keyboard, or the like. For example, the touch sensor is a resistive film type touch sensor, a capacitive touch sensor, or the like. The touch sensor acquires information indicating a designated position within a certain region. The touch sensor is configured as a touch panel integrally with the display unit 81, and thus, a signal indicating the touched position on the screen displayed on the display unit 81 is input to the system controller 87.

The communication interface 86 is an interface for communicating with other devices. For example, the communication interface 86 is used so as to communicate with a host device (external device) which transmits the print data to the image forming apparatus 1. For example, the communication interface 86 is configured as an LAN connector or the like. The communication interface 86 may perform wireless communication with other devices according to standards such as Bluetooth (registered trademark) or Wi-fi (registered trademark).

The system controller 87 controls the image forming apparatus 1. For example, the system controller 87 includes a CPU 91, a ROM 92, a RAM 93, and a nonvolatile memory 94.

The CPU 91 is an arithmetic element (for example, a processor) that executes arithmetic processing. The CPU 91 performs various processes based on data such as a program stored in the ROM 92. The CPU 91 functions as a control unit which executes the program stored in the ROM 92 so as to be able to perform various operations.

The ROM 92 is a read-only nonvolatile memory. The ROM 92 stores the program, data used in the program, or the like.

The RAM 93 is a volatile memory functioning as a working memory. The RAM 93 temporarily stores data or the like during the processing of the CPU 91. The RAM 93 temporarily stores programs executed by the CPU 91.

The nonvolatile memory 94 is a storage medium capable of storing various information. The nonvolatile memory 94 stores the program, the data used in the program, or the like. For example, the nonvolatile memory 94 is a solid state drive (SSD), a hard disk drive (HDD), or other storage units. Instead of the nonvolatile memory 94, the memory interface, such as a card slot into which a storage medium, such as a memory card can be inserted, may be provided.

The system controller 87 is connected to the ADF 13, the scanner unit 14, the conveyance unit 33, the image forming unit 41, the display unit 81, the speaker 82, the camera 83, the card reader 84, the operation interface 85, the communication interface 86, or the like via a bus or the like.

Next, various processes performed by the CPU 91 will be described.

The CPU 91 functions as an acquisition unit which executes the program stored in the ROM 92 to acquire the print data for forming the image on the printing medium P. For example, the CPU 91 receives the print data from the external device via the communication interface 86. The CPU 91 may generate the print data based on the image acquired by the scanner unit 14.

The print data may be data for forming the image on one printing medium P or may be data for forming the images on the plurality of printing mediums P. The print data may include a designation of the number (the number of copies) for printing the same content.

The CPU 91 executes the program stored in the ROM 92 to perform the printing processing of forming the image corresponding to the print data on the printing medium P by the image forming unit 41. For example, the CPU 91 inputs the print data to the image forming unit 41 and inputs a conveyance control signal instructing to convey the printing medium P to the conveyance unit 33, thereby forming an image on the surface of the printing medium P while conveying the printing medium P.

The CPU 91 executes the program stored in the ROM 92 to perform various processes relating to the toner residual amount of the toner cartridge 51.

Based on a measurement value of the toner residual amount measurement sensor 70, the CPU 91 determines whether or not exchange of the toner cartridge 51 is necessary. The CPU 91 compares the measurement result of the toner residual amount measurement sensor 70 and a preset threshold value (toner exchange threshold value) and based on a comparison result, the CPU 91 determines whether or not the exchange of the toner cartridge 51 is necessary. For example, when the measurement result of the toner residual amount measurement sensor 70 is less than the preset threshold value (toner exchange threshold value) (at a toner run-out time), the CPU 91 determines that exchange of the toner cartridge 51 is necessary. Even if the toner supply from the toner cartridge 51 is performed several times, when concentration of the toner in the developer 64 is not recovered, that is, when the measurement result of the toner residual amount measurement sensor 70 does not exceed the toner exchange threshold value, the CPU 91 may determine that it is the toner run-out.

The CPU 91 counts an operation time of the toner supply motor 67. That is, the CPU 91 counts the operation time (toner supply motor operation time) of the toner supply motor 67 for feeding the toner from the toner cartridge 51 to the developer 64 after the toner cartridge 51 is exchanged, and stores the counted value in a predetermined region on the nonvolatile memory 94. In this case, the predetermined region on the nonvolatile memory 94 in which the counted value is stored functions as a counter which counts the toner supply motor operation time.

The CPU 91 stores the toner supply motor operation time at the toner run-out time in the nonvolatile memory 94. That is, the CPU 91 stores the counter value of the motor 67 when the toner run-out is confirmed in the predetermined region on the nonvolatile memory 94 as the history information.

The CPU 91 communicates with the toner cartridge 51 connected to the terminal 68 of the loading unit 66 to acquire the identification code from the toner cartridge 51. Based on the acquired identification code, the CPU 91 determines whether or not the toner cartridge 51 is the toner cartridge 51 corresponding to the toner cartridge 51 itself.

The CPU 91 communicates with the toner cartridge 51 connected to the terminal 68 of the loading unit 66 to acquire the first toner residual amount display threshold value from the toner cartridge 51. The CPU 91 stores the acquired first toner residual amount display threshold value in the predetermined region on the nonvolatile memory 94.

The CPU 91 determines whether or not the toner in the toner cartridge 51 is in a state (near empty state) where the residual amount thereof is small. The CPU 91 calculates a threshold value (second toner residual amount display threshold value) for determining whether or not the toner is in the near empty state. For example, the CPU 91 calculates the second toner residual amount display threshold value, based on the first toner residual amount display threshold value on the nonvolatile memory 94 and the history information. The CPU 91 determines whether or not the toner is in the near empty state, based on the toner supply motor operation time after the toner cartridge 51 is loaded in the loading unit 66 and the second toner residual amount display threshold value. For example, when the toner supply motor operation time after the toner cartridge 51 is loaded in the loading unit 66 is greater than or equal to the second toner residual amount display threshold value, the CPU 91 determines that the toner is in the near empty state.

When the CPU 91 determines that the toner is in the near empty state, the CPU 91 outputs notification relating to the toner residual amount from the display unit 81, the speaker 82, or other interfaces. For example, the CPU 91 outputs that the toner residual amount is small, as the notification relating to the toner residual amount.

First Embodiment

FIG. 4 is a diagram for explaining examples of information stored in the nonvolatile memory 94 of the system controller 87 according to a first embodiment. FIG. 5 is a diagram for explaining examples of information stored in the memory 53 of the toner cartridge 51 according to the first embodiment.

As shown in FIG. 4, the nonvolatile memory 94 of the system controller 87 includes a storage region A001 in which the "identification code" is stored, a storage region A002 in which the "first toner residual amount display threshold value" which is the threshold value with respect to the toner supply motor operation time acquired from the toner cartridge 51 which can be identified by the "identification code" is stored, a storage region A003 in which the "second toner residual amount display threshold value" which is the threshold value with respect to the toner supply motor operation time calculated by a method described later is stored, a storage region A004 in which the "toner supply motor operation time" is stored, a storage region A005 in which the "toner run-out counter value" of the first previous toner cartridge 51 is stored, a storage region A006 in which the "toner run-out counter value" of the second previous toner cartridge 51 is stored, and a storage region A007 in which the "toner run-out counter value" of the third previous toner cartridge 51 is stored. The nonvolatile memory 94 may include the storage regions A001 to A007 for different identification codes.

As shown in FIG. 5, the memory 53 of the toner cartridge 51 includes a storage region B001 in which the "identification code" is stored, a storage region B002 in which the "first toner residual amount display threshold value" is stored, and a storage region B003 in which the "toner supply motor operation time" is stored.

Figure 6:
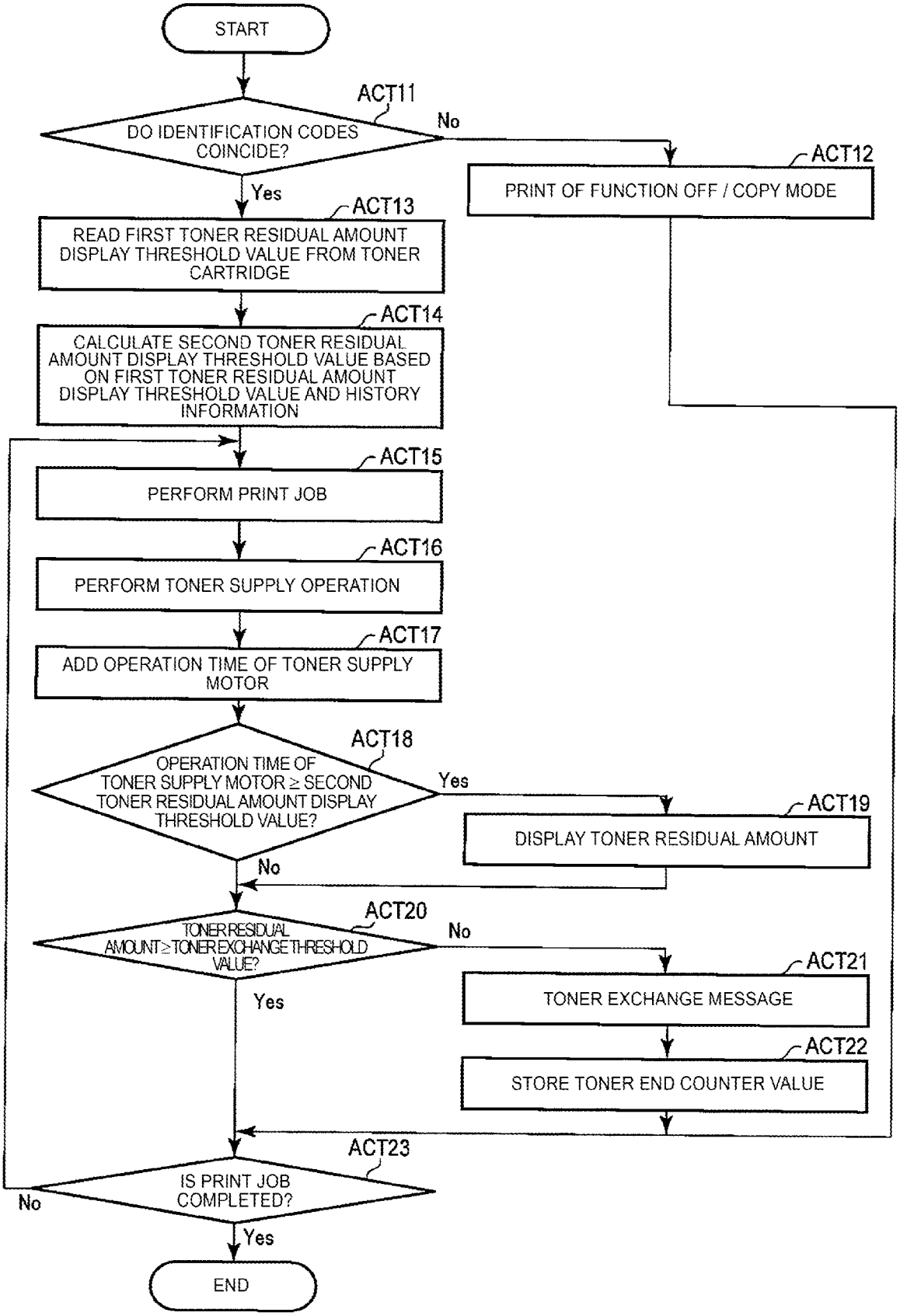
FIG. 6 is a flowchart for explaining an example of an operation of the system controller according to the first embodiment.

FIG. 6 is a flowchart for explaining an example of the operation of the system controller 87 according to the first embodiment.

At a timing when a power source of the image forming apparatus 1 is turned on or at a timing when a front cover covering the loading unit 66 of the process unit 42 of the image forming apparatus 1 is opened or closed, the CPU 91 of the system controller 87 determines whether or not the identification code of the storage region A001 of the nonvolatile memory 94 and the identification code of the storage region B001 of the memory 53 of the toner cartridge 51 coincide with each other (Act 11). When the CPU 91 determines that the identification codes do not coincide with each other (NO in Act 11), the mode proceeds to a print copy mode (of function OFF) in which the residual amount of the toner based on the second toner residual amount display threshold value is not displayed (Act 12) and proceeds to Act 23 described later.

When the CPU 91 determines that the identification codes coincide with each other (YES in Act 11), the first toner residual amount display threshold value of the storage region B002 of the memory 53 of the toner cartridge 51 is read and is stored in the storage region A002 of the nonvolatile memory 94 (Act 13), and the state proceeds to a ready state where a print JOB can be performed.

The CPU 91 calculates the second toner residual amount display threshold value based on the first toner residual amount display threshold value of the storage region A002 and the history information of the storage region A005 to the storage region A007 and stores the second toner residual amount display threshold value in the storage region A003 (Act 14).

The first toner residual amount display threshold value is a value by which the image forming apparatus 1 determines whether or not the residual amount of the toner in the toner cartridge 51 is small (near empty state). First, the CPU 91 converts the first toner residual amount display threshold value into a value corresponding to the toner run-out time. For example, when the first toner residual amount display threshold value is for displaying the residual amount of the toner being 10% as the display of the toner residual amount, the CPU 91 multiplies the first toner residual amount display threshold value by 10/9 and thus, converts the first toner residual amount display threshold value into a value corresponding to the toner run-out time.

Figure 7:
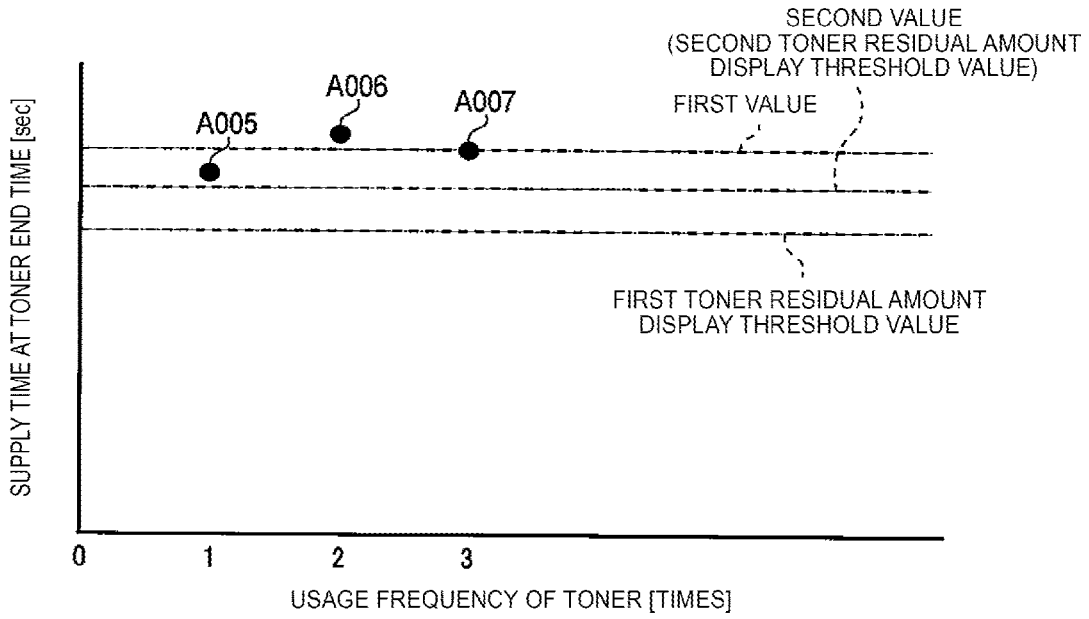
FIG. 7 is a graph for explaining an example of calculation of a second toner residual amount display threshold value according to the first embodiment.

For example, the CPU 91 calculates an average value of the toner run-out counter values of the history information. That is, as shown in FIG. 7, the CPU 91 calculates an average value (first value) of the toner run-out counter value of the storage region A005, the toner run-out counter value of the storage region A006, and the toner run-out counter value of the storage region A007. Next, the CPU 91 calculates an average value (second value) of the first value and the converted first toner residual amount display threshold value. The CPU 91 converts the second average value into a value for determining near empty and stores the converted value in the storage region A003 as the second toner residual amount display threshold value. For example, when the CPU 91 displays the residual amount of the toner being 10% as the toner residual amount, the CPU 91 multiplies the second average value by 9/10 and thus, converts the second average value into the second toner residual amount display threshold value.

A method of calculating the second toner residual amount display threshold value based on the first toner residual amount display threshold value and the history information may be any method. For example, the CPU 91 may calculate a median value of the toner run-out counter value of the history information, calculate the second toner residual amount display threshold value using a median value of the calculated median value and the first toner residual amount display threshold value converted as described above, and store the calculated second toner residual amount display threshold value in the storage region A003. In order to calculate the second toner residual amount display threshold value, the median value may not be used and a standard deviation or the like may be used.

Figure 8:
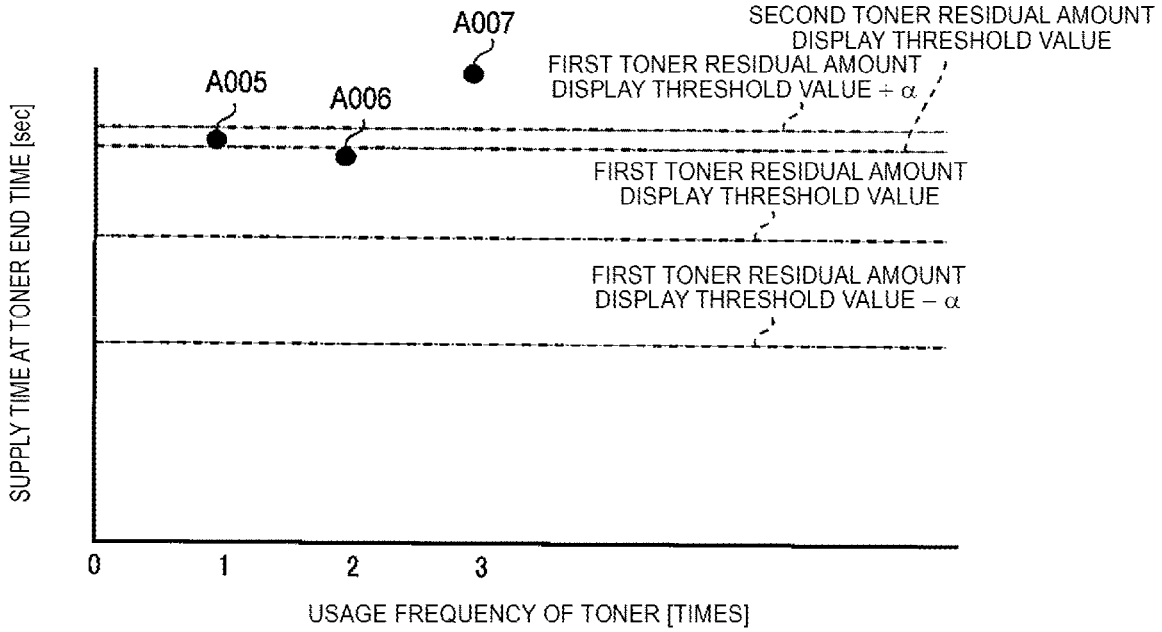
FIG. 8 is a graph for explaining another example of the calculation of a second toner residual amount display threshold value according to the first embodiment.

The CPU 91 may exclude the history information outside the preset range (adoption range) among the history information from the calculation of the second toner residual amount display threshold value. FIG. 8 shows an example in which the first toner residual amount display threshold value $\pm\alpha$, converted as described above, is set as the adoption range. In this example, the toner run-out counter value of the storage region A005 and the toner run-out counter value of the storage region A006 are within the adoption range, and the toner run-out counter value of the storage region A007 is outside the adoption range. In this case, the CPU 91 calculates an average value of the toner run-out counter value of the storage region A005 and the toner run-out counter value of the storage region A006 as the first value, and calculates the second toner residual amount display threshold value using an average value of the first value and the first toner residual amount display threshold value converted as described above.

When the CPU 91 calculates the first value, the CPU 91 may multiply the toner run-out counter value of the storage region A005, the toner run-out counter value of the storage region A006, and the toner run-out counter value of the storage region A007 by different counts. For example, the CPU 91 may use a sum of the toner run-out counter value×0.5 of the storage region A005, the toner run-out counter value×0.3 of the storage region A006, and the toner run-out counter value×0.2 of the storage region A007 as the first value. Even when the CPU 91 calculates the second toner residual amount display threshold value based on the first value and the first toner residual amount display threshold value converted as described above, the CPU 91 may multiply different counts. For example, the CPU 91 multiplies the first value by a small count and multiplies the first toner residual amount display threshold value by a large count, and thus, the first toner residual amount display threshold value can be emphasized. In this way, the CPU 91 can flexibly calculate the second toner residual amount display threshold value by weighting each of the plurality of values used when the CPU 91 calculates the second toner residual amount display threshold value.

When the CPU 91 receives the print data in the ready state, the CPU 91 performs the print JOB based on the print data (Act 15). The CPU 91 may read the toner supply motor operation time of the storage region B003 of the memory 53 of the toner cartridge 51 and store the toner supply motor operation time in the storage region A004 of the nonvolatile memory 94.

The CPU 91 causes the toner supply motor 67 to perform the toner supply operation while the print JOB is performed (Act 16). That is, the CPU 91 controls the toner supply motor 67 so as to feed the toner in the toner cartridge 51 loaded in the loading unit 66 to the developer 64.

The CPU 91 counts the time during which the toner supply motor 67 is operated in the Act 16 and adds the counted time to the toner supply motor operation time of the storage region A004

The CPU 91 determines whether or not the toner supply motor operation time of the storage region A004 is equal to or more than the second toner residual amount display threshold value of the storage region A003 (Act 18). When the CPU 91 determines that the toner supply motor operation time of the storage region A004 is less than the second toner residual amount display threshold value of the storage region A003 (NO in Act 18), the processing proceeds to processing of Act 20.

When the CPU 91 determines that the toner supply motor operation time of the storage region A004 is equal to or more than the second toner residual amount display threshold value of the storage region A003 (YES in Act 18), information relating to the toner residual amount is displayed (Act 19), and the processing proceeds to processing of Act 20. For example, the information relating to the toner residual amount is information for notifying that the toner residual amount is small. The CPU 91 may display any one as the information relating to the toner residual amount. For example, the CPU 91 may approximately calculate a percentage indicating the residual amount of the toner and display the calculated percentage.

The CPU 91 determines whether or not the measurement result of the toner residual amount measurement sensor 70 is equal to or more than a preset toner exchange threshold value (Act 20). For example, the CPU 91 may perform the determination of Act 20 for a predetermined time. That is, when the measurement result of the toner residual amount measurement sensor 70 in the developer 64 is not returned to a value equal to or more than the toner exchange threshold value for the predetermined time, the CPU 91 may determine that the measurement result of the toner residual amount measurement sensor 70 is less than the preset toner exchange threshold value.

When the CPU 91 determines that the measurement result of the toner residual amount measurement sensor 70 is equal to or more than the preset toner exchange threshold value (YES in Act 20), the processing proceeds to processing of Act 23.

When the CPU 91 determines that the measurement result of the toner residual amount measurement sensor 70 is less than the preset toner exchange threshold value (NO in Act 20), the CPU 91 determines that the exchange of the toner cartridge 51 is necessary (it is the toner run-out) and displays a message urging the exchange of the toner cartridge 51 (Act 21).

The CPU 91 stores the toner run-out counter value which is the toner supply motor operation time at the toner run-out time in the nonvolatile memory 94 (Act 22), and the processing proceeds to the processing of Act 23. For example, the CPU 91 overwrites the toner run-out counter value of the storage region A006 on the storage region A007, overwrites the toner run-out counter value of the storage region A005 on the storage region A006, and overwrites the toner supply motor operation time of A004 on the storage region A005 as the toner run-out counter value.

Based on the received print data, the CPU 91 determines whether or not the print JOB is completed (Act 23). For example, when the CPU 91 determines that the print JOB is not completed (NO in Act 23), the processing proceeds to the processing of Act 15, and the print JOB is continued. When the CPU 91 determines that the print JOB is completed (YES in Act 23), the print JOB ends, and after a predetermined time elapses, the state proceeds from the ready state to a standby state.

As described above, the image forming apparatus 1 includes the loading unit 66 on which the toner cartridge 51 filled with the toner is loaded, the developer 64 which performs the development by the toner of the toner cartridge 51 loaded on the loading unit 66, the toner supply motor 67 which supplies the toner of the toner cartridge to the developer 64, the nonvolatile memory 94 which stores the information, and the CPU 91. The CPU 91 stores the operation time of the toner supply motor after the toner cartridge 51 is loaded on the loading unit 66 at the toner run-out time in the nonvolatile memory 94 as the history information. Based on the first toner residual amount display threshold value acquired from the toner cartridge 51 and the history information, the CPU 91 calculates the second toner residual amount display threshold value, and when the operation time of the toner supply motor exceeds the second toner residual amount display threshold value, the CPU 91 outputs the notification relating to the toner residual amount. In this way, in the image forming apparatus 1, based on the first toner residual amount display threshold value stored in the toner cartridge 51 and the history of the operation time of the toner supply motor at the toner run-out time, it is possible to calculate the second toner residual amount display threshold value by which it may be determined whether or not the notification relating to the toner residual amount is output. A difference of the toner supply operation for each image forming apparatus 1, a difference of the toner supply performance for each toner cartridge, or the like is reflected in the history of the operation time of the toner supply motor at the toner run-out time. Accordingly, the CPU 91 may calculate the second toner residual amount display threshold value taking into account both the history information to which the difference of the toner supply operation for each image forming apparatus 1, the difference of the toner supply performance for each toner cartridge, or the like is reflected, and the first toner residual amount display threshold value which is a theoretical value. Accordingly, the CPU 91 can estimate the toner residual amount with high accuracy. As a result, in the image forming apparatus 1, based on the second toner residual amount display threshold value closer to an actual value, it is possible to output the notification relating to the toner residual amount.

In the above example, the CPU 91 stores the total operation time, at the toner run-out time, of the toner supply motor 67 after the toner cartridge 51 is loaded on the loading unit 66, in the nonvolatile memory 94 as the history information. However, exemplary embodiments described herein are not limited to this configuration. The CPU 91 may count the total number of the rotations of the toner supply motor 67 at the toner run-out time and may store the counted number of the rotations in the nonvolatile memory 94 and the nonvolatile memory 53, as the history information. In this case, the first toner residual amount display threshold value and the second toner residual amount display threshold value indicate the rotational number of the rotations of the toner supply motor 67. The CPU 91 calculates the second toner residual amount display threshold value based on the history information and the first toner residual amount display threshold value to determine the toner cartridge is nearly empty.

That is, the CPU 91 may sequentially generate the toner supply indexes for estimating the amount of the toner supplied by the toner supply motor 67 and may store the toner supply index at the toner run-out time in the nonvolatile memory 94 as the history information.

For example, the CPU 91 may calculate an integrated value (counted value) of pixel values for each color after the toner cartridge 51 is loaded on the loading unit 66, as the toner supply index. For example, the CPU 91 may calculate a drive time of the process unit 42 after the toner cartridge 51 is loaded on the loading unit 66, as the toner supply index.

In this case, based on the first toner residual amount display threshold value acquired from the toner cartridge 51 and the history information, the CPU 91 calculates the second toner residual amount display threshold value, and when the toner supply index exceeds the second toner residual amount display threshold value, the CPU 91 outputs the notification relating to the toner residual amount.

The CPU 91 of the system controller 87 of the image forming apparatus 1 converts the first toner residual amount display threshold value into a value corresponding to the toner run-out and calculates the second toner residual amount display threshold value using the average value of the history information and the average value of the converted first toner residual amount display threshold values. Accordingly, the CPU 91 can calculate the second toner residual amount display threshold value, using the average of the history information to which the difference of the toner supply operation for each image forming apparatus 1, the difference of the toner supply performance for each of the toner cartridges, or the like is reflected and the first toner residual amount display threshold value which is the theoretical value.

The CPU 91 of the system controller 87 of the image forming apparatus 1 may calculate the median value or the standard deviation of the history information and the median value or the standard deviation of the first toner residual amount display threshold value converted as described above, as the second toner residual amount display threshold value.

In the above-described embodiment, in Act 11 and Act 12 of FIG. 6, when the CPU 91 determines that the identification codes do not coincide with each other, the residual amount of the toner is not displayed. However, exemplary embodiments described herein are not limited to this configuration. The CPU 91 may store a near empty display threshold value with respect to the toner cartridge in which the identification code cannot be recognized in the memory 94, compare the near empty display threshold value and the toner supply motor operation time of the storage region A004 with each other, and display the residual amount of the toner according to the comparison result.

The CPU 91 compares the near empty display threshold value acquired from the nonvolatile memory 94 and the toner supply motor operation time of the storage region A004 with each other, and when the toner supply motor operation time reaches the near empty display threshold value, the CPU 91 determines that the state of the toner is near empty and displays this near empty state. Accordingly, in the image forming apparatus 1, even when a non-genuine product is loaded, it is possible to display the near empty.

In the above-described embodiment, the CPU 91 calculates the second toner residual amount display threshold value based on the first toner residual amount display threshold value stored in the storage region A002 and the history information, and writes the calculated second toner residual amount display threshold value to the storage region A003. However, exemplary embodiments described herein are not limited to this. The CPU 91 may write the calculated second toner residual amount display threshold value to the storage region A002.

Second Embodiment

Figures 10, 11:
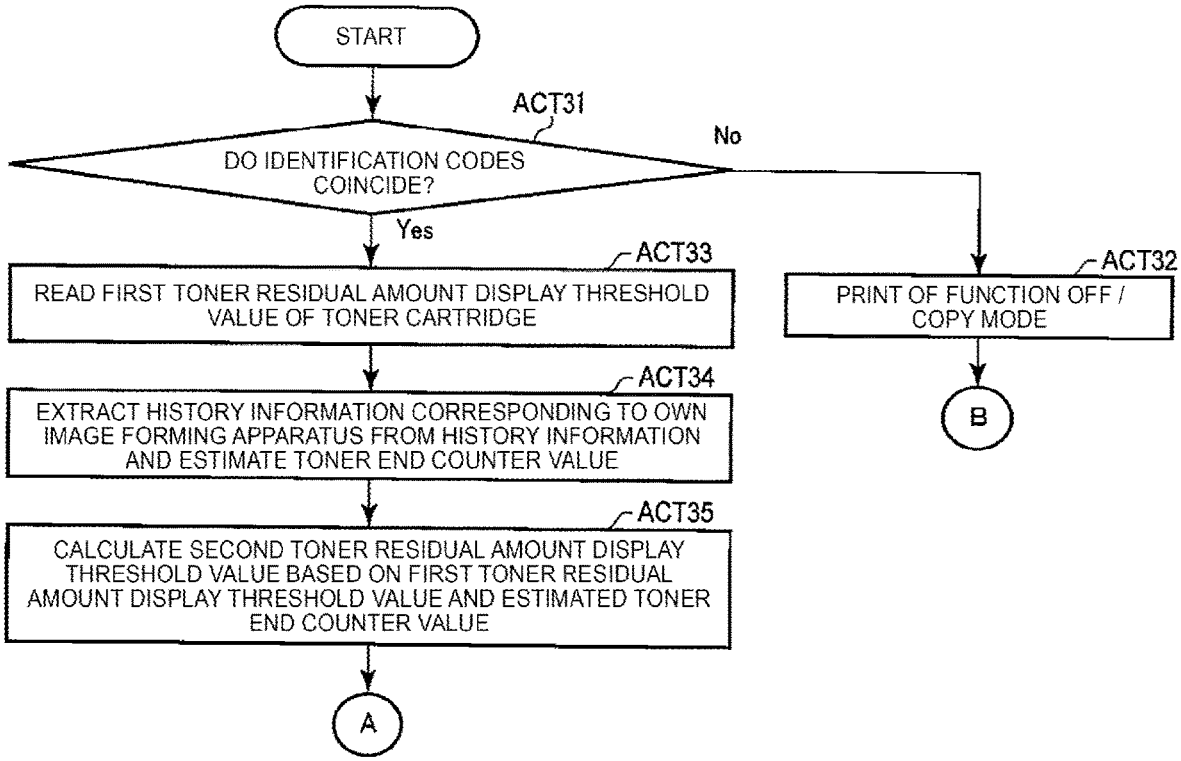
FIG. 10 is a diagram for explaining examples of information stored in a memory of a toner cartridge according to the second embodiment.
FIG. 11 is a flowchart for explaining an example of an operation of the system controller according to the second embodiment.

FIG. 9 is a diagram for explaining examples of information stored in the nonvolatile memory 94 of the system controller 87 according to a second embodiment. FIG. 10 is a diagram for explaining examples of information stored in the memory 53 of the toner cartridge 51 according to the second embodiment.

As shown in FIG. 9, the nonvolatile memory 94 of the system controller 87 includes the storage region A001 in which the "identification code" is stored, the storage region A002 in which the "first toner residual amount display threshold value" is stored, the storage region A003 in which the "second toner residual amount display threshold value" is stored, the storage region A004 in which the "apparatus number" of the own image forming apparatus is stored, the storage region A005 in which the "toner supply motor operation time" is stored, and the storage region A006 to the storage region A012 in which the "toner run-out counter value" for each "apparatus number" of the first previous toner cartridge 51 is stored. The nonvolatile memory 94 includes storage regions in which the "toner run-out counter value" for each "apparatus number" of each of the second previous toner cartridge 51 and the third previous toner cartridge 51 is stored in regions after the storage region A013.

As shown in FIG. 10, the memory 53 of the toner cartridge 51 includes the storage region B001 in which the "identification code" is stored, the storage region B002 in which the "first toner residual amount display threshold value" is stored, the storage region B003 in which the "apparatus number" is stored, and a storage region B004 in which the "toner supply motor operation time" in the apparatus number of B003 is stored. The memory 53 includes a plurality of storage regions in which the "apparatus numbers" and the "toner supply motor operation times" are stored. That is, the memory 53 stores the toner supply motor operation time counted by the image forming apparatus 1 for each image forming apparatus 1 indicated by the apparatus number.

Figure 12:
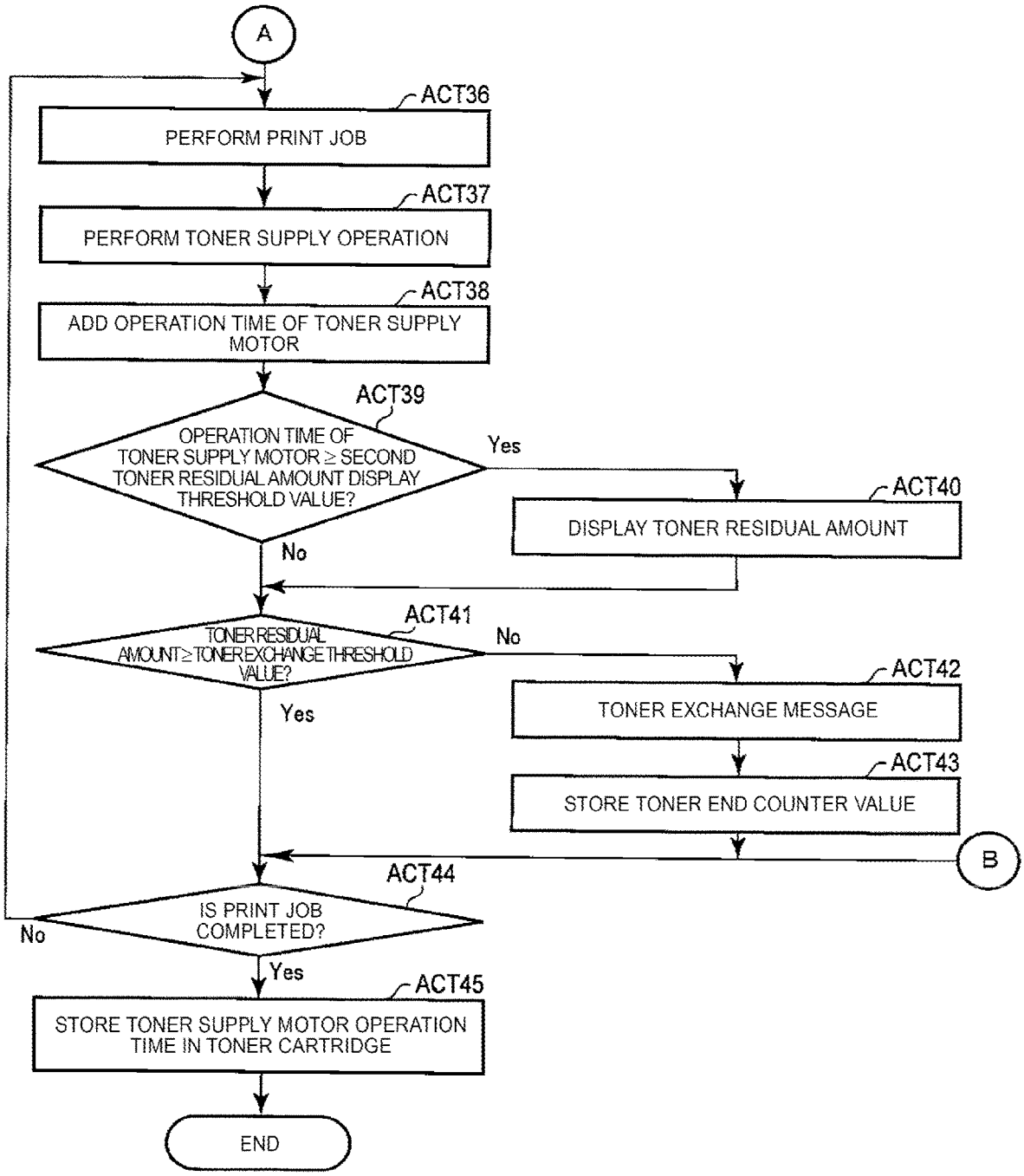
FIG. 12 is a flowchart for explaining the example of the operation of the system controller according to the second embodiment.

FIGS. 11 and 12 are diagrams for explaining an example of an operation of the system controller 87 according to the second embodiment.

At the timing when the power source of the image forming apparatus 1 is turned on or at the timing when the front cover covering the loading unit 66 of the process unit 42 of the image forming apparatus 1 is opened or closed, the CPU 91 of the system controller 87 determines whether or not the identification code of the storage region A001 of the nonvolatile memory 94 and the identification code of the storage region B001 of the memory 53 of the toner cartridge 51 coincide with each other (Act 31). When the CPU 91 determines that the identification codes do not coincide with each other (NO in Act 31), the mode proceeds to the print copy mode (of function OFF) in which the processing relating to the residual amount of the toner is not performed (Act 32) and proceeds to Act 44 described later.

When the CPU 91 determines that the identification codes coincide with each other (YES in Act 31), the first toner residual amount display threshold value of the storage region B002 of the memory 53 of the toner cartridge 51 is read and is stored in the storage region A002 of the nonvolatile memory 94 (Act 33), the state proceeds to a ready state where the print JOB can be performed.

The CPU 91 extracts the history information corresponding to the "apparatus number" of the own image forming apparatus from the history information stored in the storage regions after the storage region A006 of the nonvolatile memory 94 (Act 34). The CPU 91 extracts a ratio of the toner supply motor operation time of the own image forming apparatus with respect to a sum of the toner supply motor operation times of the plurality of image forming apparatuses in the history for each toner cartridge. Based on the ratio of the toner supply motor operation time of the own image forming apparatus, the CPU 91 estimates the toner run-out counter value for each toner cartridge when the own image forming apparatus uses the toner cartridge 51 from a toner full state to the toner run-out state. Specifically, according to the example of FIG. 9, when the CPU 91 estimates the toner run-out counter value of the first previous toner cartridge, the CPU 91 refers to the storage region A007 to the storage region A012. The CPU 91 calculates a total value of the toner supply motor operation time of the storage region A008, the toner supply motor operation time of the storage region A010, and the toner supply motor operation time of the storage region A012. The CPU 91 divides the toner supply motor operation time of the storage region A008 corresponding to the own image forming apparatus by the total value. The CPU 91 multiplies a reciprocal of the divided value and the toner supply motor operation time of the storage region A008 together to estimate the toner run-out counter value. The CPU 91 performs this processing on each of the first previous toner cartridge, the second previous toner cartridge, and the three previous toner cartridge so as to calculate.

The CPU 91 calculates the second toner residual amount display threshold value based on the first toner residual amount display threshold value of the storage region A002 and the toner run-out counter value estimated for each toner cartridge, and stores the second toner residual amount display threshold value in the storage region A003 (Act 35). The method of calculating the second toner residual amount display threshold value based on the toner run-out counter value and the first toner residual amount display threshold value is similar to that of the first embodiment, and thus, the descriptions of the method are omitted.

When the CPU 91 receives the print data in the ready state, the print JOB is performed based on the print data (Act 36). When the toner supply motor operation time associated with the apparatus number coinciding with the own image forming apparatus is stored in the memory 53 of the toner cartridge 51, the CPU 91 may store the toner supply motor operation time in the storage region A005 of the nonvolatile memory 94. For example, when the storage region of the memory 53 of the toner cartridge 51 is provided as shown in FIG. 10, the CPU 91 stores the toner supply motor operation time of the storage region B004 associated with the storage region B003 of the apparatus number coinciding with the own image forming apparatus in the storage region A005 of the nonvolatile memory 94.

The CPU 91 causes the toner supply motor 67 to perform the toner supply operation while the print JOB is performed (Act 37). That is, the CPU 91 controls the toner supply motor 67 so as to feed the toner in the toner cartridge 51 loaded in the loading unit 66 to the developer 64.

The CPU 91 counts the time during which the toner supply motor 67 is operated in the Act 37 and adds the counted time to the toner supply motor operation time of the storage region A005 (Act 38).

The CPU 91 determines whether or not the toner supply motor operation time of the storage region A005 is equal to or more than the second toner residual amount display threshold value of the storage region A003 (Act 39). When the CPU 91 determines that the toner supply motor operation time of the storage region A005 is less than the second toner residual amount display threshold value of the storage region A003 (NO in Act 39), the processing proceeds to processing of Act 41.

When the CPU 91 determines that the toner supply motor operation time of the storage region A005 is equal to or more than the second toner residual amount display threshold value of the storage region A003 (YES in Act 39), information relating to the toner residual amount is displayed (Act 40), and the processing proceeds to processing of Act 41.

The CPU 91 determines whether or not the measurement result of the toner residual amount measurement sensor 70 is equal to or more than a preset toner exchange threshold value (Act 41). For example, the CPU 91 may perform the determination of Act 41 for a predetermined time. That is, when the measurement result of the toner residual amount measurement sensor 70 in the developer 64 is not returned to a value equal to or more than the toner exchange threshold value for the predetermined time, the CPU 91 may determine that the measurement result of the toner residual amount measurement sensor 70 is less than the preset toner exchange threshold value.

When the CPU 91 determines that the measurement result of the toner residual amount measurement sensor 70 is equal to or more than the preset toner exchange threshold value (YES in Act 41), the processing proceeds to processing of Act 44.

When the CPU 91 determines that the measurement result of the toner residual amount measurement sensor 70 is less than the preset toner exchange threshold value (NO in Act 41), the CPU 91 determines that the exchange of the toner cartridge 51 is necessary (it is the toner run-out) and displays a message urging the exchange of the toner cartridge 51 (Act 42).

The CPU 91 stores the toner run-out counter value which is the toner supply motor operation time at the toner run-out time in the nonvolatile memory 94 (Act 43), and the processing proceeds to the processing of Act 44. For example, the CPU 91 writes the toner supply operation times associated with other image forming apparatuses stored in the memory 53 of the toner cartridge 51 at the toner run-out time and the storage region A005 of the nonvolatile memory 94 of the own image forming apparatus to the nonvolatile memory 94 as the history information of the toner run-out counter value of one toner cartridge 51. Specifically, when the storage region of the memory 53 of the toner cartridge 51 is provided as shown in FIG. 10, the CPU 91 stores the toner supply motor operation time of the storage region B006 and the toner supply motor operation time of the storage region B008 which are the history in the own image forming apparatus and other image forming apparatuses and the toner supply motor operation time of the storage region A005 of the nonvolatile memory 94 of the own image forming apparatus in the nonvolatile memory 94 as the history information of one toner cartridge 51. Each toner supply motor operation time and the apparatus number indicating which apparatus is counted are associated with each other, and the CPU 91 stores the associated one in the nonvolatile memory 94. That is, for each toner cartridge 51, the CPU 91 stores the history information in which the apparatus number of the image forming apparatus 1 and the toner supply motor operation time are associated with each other in the nonvolatile memory.

Based on the received print data, the CPU 91 determines whether or not the print JOB is completed (Act 44). For example, when the CPU 91 determines that the print JOB is completed (YES in Act 44), the print JOB ends, the toner supply motor operation time is stored in the memory 53 of the toner cartridge 51 (Act 45), and after a predetermined time elapses, the state proceeds from the ready state to the standby state.

As described above, according to the second embodiment, the memory 53 of the toner cartridge 51 stores the toner supply motor operation time for each apparatus number for specifying the image forming apparatus 1. The CPU 91 of the image forming apparatus 1 stores the toner supply motor operation time for each apparatus number of the image forming apparatus 1 stored in the memory 53 of the toner cartridge 51 and the toner supply motor operation time of the own image forming apparatus at the toner run-out time in the nonvolatile memory 94 as the history information. Based on the ratio of the toner supply motor operation time of the own image forming apparatus with respect to the sum of the toner supply motor operation times, the CPU 91 estimates the toner run-out counter value for each toner cartridge. Based on the estimated value of the toner run-out counter value for each toner cartridge and the first toner residual amount display threshold value, the CPU 91 calculates the second toner residual amount display threshold value. According to the configuration, in the image forming apparatus 1, even when one toner cartridge 51 is used in the plurality of image forming apparatuses 1, the second toner residual amount display threshold value close to the actual value can be calculated.

It is to be noted that the functions described in the above embodiments can be realized not only by using hardware but also by loading a program describing each function using software into a computer. Each function may be configured by appropriately selecting software or hardware.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus on which a toner cartridge is mounted to be exchangeable, comprising:

the toner cartridge including an accommodation container configured to accommodate toner, and including a memory configured to store a first toner residual amount display threshold value;

a developer configured to perform development by the toner supplied from the toner cartridge; and a processor configured to:

store a toner supply index at a toner run-out time in the memory as history information, wherein the toner supply index indicates an amount of the toner supplied to the developer from at least one toner cartridge used before the toner cartridge mounted on the image forming apparatus, estimate a toner run-out counter value, which is the toner supply index when the toner runs out, based on a ratio of the toner supply index of the image forming apparatus, and calculate a second toner residual amount display threshold value based on the estimated toner run-out counter value and the first toner residual amount display threshold value acquired from the toner cartridge.

2. The apparatus according to claim 1, wherein the toner cartridge includes a screw configured to be rotatable to supply the toner in the accommodation container to the developer, wherein the toner cartridge further includes a motor configured to rotate the screw, and a counter configured to count a rotation time or a rotating speed of the motor, and wherein the processor uses the rotation time or the rotating speed of the motor as the toner supply index.

3. The apparatus according to claim 1, wherein the processor is configured to:

convert the first toner residual amount display threshold value into a value corresponding to the toner run-out time, and calculate the second toner residual amount display threshold value, based on an average value of the toner supply indexes at the toner run-out time of the toner cartridge used before the toner cartridge mounted on the image forming apparatus, and based on the converted first toner residual amount display threshold value.

4. The apparatus according to claim 3, wherein the average value of the toner supply indexes is determined using different weights.

5. The apparatus according to claim 3, wherein the processor is configured to exclude the toner supply index, when the toner supply index is out of a preset range, from the calculation of the second toner residual amount display threshold value.

6. The apparatus according to claim 1, wherein the processor is configured to acquire the toner supply index in another image forming apparatus from the toner cartridge at the toner run-out time, and to store the acquired toner supply index and the toner supply index of the image forming apparatus in the memory as the history information.

7. A control method of an image forming apparatus which includes a toner cartridge having an accommodation container configured to accommodate toner and a memory configured to store a first toner residual amount display threshold value, a developer configured to perform development by the toner supplied from the toner cartridge, and a processor, and on which the toner cartridge is mounted to be exchangeable, the method comprising:

causing the processor:

to store a toner supply index at a toner run-out time in the memory as history information, wherein the toner supply index indicates an amount of the toner supplied to the developer from at least one toner cartridge used before the toner cartridge mounted on the image forming apparatus, to estimate a toner run-out counter value, which is the toner supply index when the toner runs out, based on a ratio of the toner supply index of the image forming apparatus, and to calculate a second toner residual amount display threshold value based on the estimated toner run-out counter value and the first toner residual amount display threshold value acquired from the toner cartridge.

8. The method according to claim 7, wherein the toner cartridge includes a screw configured to be rotatable to supply the toner in the accommodation container to the developer, wherein the toner cartridge further includes a motor configured to rotate the screw, and a counter configured to count a rotation time or a rotating speed of the motor, and causing the processor to use the rotation time or the rotating speed of the motor as the toner supply index.

9. The method according to claim 7, wherein the processor is caused to convert the first toner residual amount display threshold value into a value corresponding to the toner run-out time, and calculate the second toner residual amount display threshold value, based on an average value of the toner supply indexes at the toner run-out time of the toner cartridge used before the toner cartridge mounted on the image forming apparatus, and based on the converted first toner residual amount display threshold value.

10. The method according to claim 9, wherein the average value of the toner supply indexes is determined using different weights.

11. The method according to claim 9, wherein the processor is caused to exclude the toner supply index, when the toner supply index is out of a preset range, from the calculation of the second toner residual amount display threshold value.

12. The method according to claim 7, wherein the processor is caused to acquire the toner supply index in another image forming apparatus from the toner cartridge at the toner run-out time, and to store the acquired toner supply index and the toner supply index of the own image forming apparatus in the memory as the history information.

13. A non-transitory computer readable medium storing a program, which when executed by a processor, causes the processor to execute a control method of an image forming apparatus which includes a toner cartridge having an accommodation container configured to accommodate toner and a memory configured to store a first toner residual amount display threshold value, a developer configured to perform development by the toner supplied from the toner cartridge, and the processor, and on which the toner cartridge is mounted to be exchangeable, the method comprising:

causing the processor:

to store a toner supply index at a toner run-out time in the memory as history information, wherein the toner supply index indicates an amount of the toner supplied to the developer from at least one toner cartridge used before the toner cartridge mounted on the image forming apparatus, to estimate a toner run-out counter value, which is the toner supply index when the toner runs out, based on a ratio of the toner supply index of the image forming apparatus, and to calculate a second toner residual amount display threshold value based on the estimated toner run-out counter value and the first toner residual amount display threshold value acquired from the toner cartridge.

14. The non-transitory computer readable medium according to claim 13, wherein the toner cartridge includes a screw configured to be rotatable to supply the toner in the accommodation container to the developer, wherein the toner cartridge further includes a motor configured to rotate the screw, and a counter configured to count a rotation time or a rotating speed of the motor, and the method causes the processor to use the rotation time or the rotating speed of the motor as the toner supply index.

15. The non-transitory computer readable medium according to claim 13, wherein the method causes the processor:

to convert the first toner residual amount display threshold value into a value corresponding to the toner run-out time, and to calculate the second toner residual amount display threshold value, based on an average value of the toner supply indexes at the toner run-out time of the toner cartridge used before the toner cartridge mounted on the image forming apparatus, and based on the converted first toner residual amount display threshold value.

16. The non-transitory computer readable medium according to claim 15, wherein the method causes the processor to exclude the toner supply index, when the toner supply index is out of a preset range, from the calculation of the second toner residual amount display threshold value.

17. The non-transitory computer readable medium according to claim 13, wherein the method causes the processor to acquire the toner supply index in another image forming apparatus from the toner cartridge at the toner run-out time, and to store the acquired toner supply index and the toner supply index of the image forming apparatus in the memory as the history information.

* * * * *